United States Patent [19]

Bauers et al.

[11] Patent Number: 4,522,011

[45] Date of Patent: Jun. 11, 1985

[54] CONTINUOUS MOTION PACKER CONTROLLER

[76] Inventors: Barton M. Bauers, 30 Hillock Dr., Wallingford, Conn. 06492; John L. Raudat, Old Madison Rd., North Madison, Conn. 06443; Raymond C. Ehlers, Old Turnpike Rd., Haddam, Conn. 06438; Timothy H. Thompson, Meetinghouse Hill Rd., Durham, Conn. 06422

[21] Appl. No.: 565,412

[22] Filed: Dec. 27, 1983

[51] Int. Cl.[3] ..... B65B 35/54; B65B 57/14

[52] U.S. Cl. ..... 53/55; 53/247; 53/495

[58] Field of Search ..... 53/55, 57, 56, 58, 494, 53/495, 499, 69, 73, 77, 247, 248

[56] References Cited

U.S. PATENT DOCUMENTS

| | | | |
|---|---|---|---|
| 3,039,248 | 6/1962 | Jones | 53/494 X |
| 3,589,094 | 6/1971 | Pearson | 53/495 X |
| 3,766,706 | 10/1973 | Graham | 53/495 X |
| 3,832,826 | 9/1974 | Ullman | 53/495 X |
| 3,852,938 | 12/1974 | Graff | 53/495 X |
| 4,457,121 | 7/1984 | Johnson et al. | 53/56 |

*Primary Examiner*—James F. Coan

[57] ABSTRACT

A controller for a continuous motion drop bottle type case packer has a real time processing means for accessing a plurality of controller instructions and for determining one of a number of possible courses of action to be taken in response to control signals from a plurality of detectors in the packer. The controller is responsive to changing operational parameters and causes the packer to operate at the maximum of a number of predetermined bottle transfer rates as selected by the real time processing means.

5 Claims, 6 Drawing Figures

CONTINUOUS MOTION PACKER CONTROLLER

BACKGROUND OF THE INVENTION

This invention relates generally to controllers for packers of the type which drop articles into upwardly open packing cases, and deals more particularly with control signal processing methodology and apparatus for the operation of such a controller.

Controllers used with drop type packers generally provide a start-stop operative control mode which is responsive to either a manual start-stop command signal or an automatic shutdown signal generated when any type or degree of packer, article feed or case feed malfunction is encountered. Since these controllers often have only limited decision making capabilities major and minor faults generally cannot be distinguished, and therefore the controller responds to both types in a like manner without regard to the severity and extent of the problem and the overall effect upon the packing process.

Furthermore, these controllers provide very limited or non-existent degrees of diagnostic aids for the human operator. Generally, only an audible or visual alarm of some type is used to alert an operator that a major malfunction or some other abnormality has occurred. In some cases, rudimentary diagnostic aid in the form of a pilot light or the like is provided within the packer itself, remote from the control panel, to indicate the probable section of the packer in which the trouble has occurred.

The general aim of the present invention is to provide an improved controller for use with drop type packers.

More specifically, it is an object of the present invention to provide a control signal processing implementation for a continuous motion type article packer which provides for an automatic and orderly increase and decrease in the article transfer rate to accommodate a number of changing operational conditions.

It is a further object of the present invention to provide a controller capable of detecting a variety of fault conditions and then choosing one of a number of predetermined courses of action in response to the fault detected.

Other features and advantages of the present invention will become apparent from the accompanying drawings and the following written description of one specific illustrative embodiment thereof.

SUMMARY

The invention resides in a controller for a continuous motion drop type packer that has article conveyor means for continuously advancing articles to an infeed station to fill a grid structure, and a packing case conveyor means which brings to a discharge station where upwardly open cases receive slugs of articles from the grid structure as both the grid structure and case move through the discharge station without stopping. A plurality of detectors provide control signals to indicate the presence or absence of articles and cases and a real time processing means accesses a plurality of controller instructions stored in a memory to execute certain of these accessed instructions in response to article and case detector control signals to cause the packer to operate in accordance with one of a number of possible courses of action.

DETAILED DESCRIPTION

Figure 1:
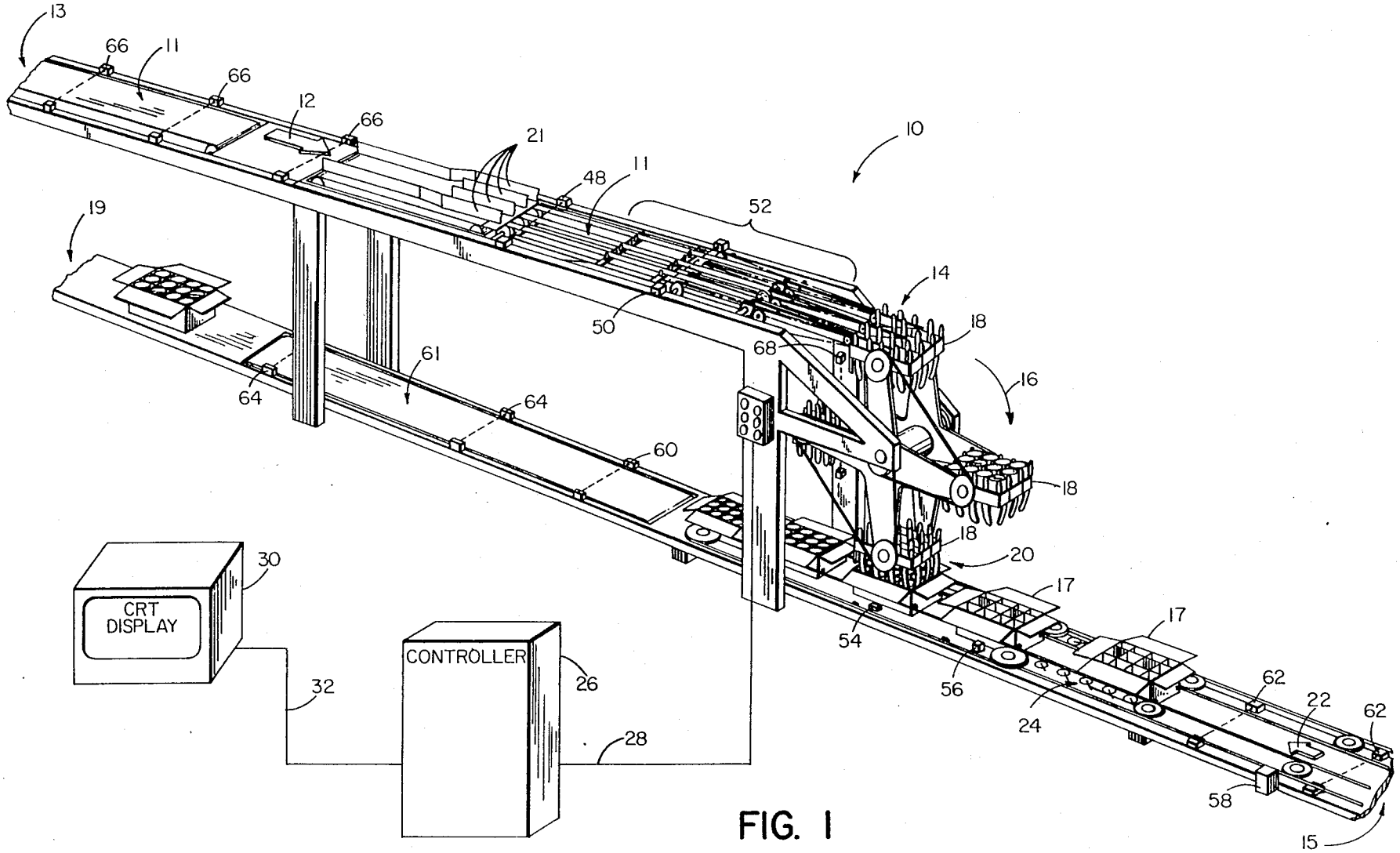
FIG. 1 is a perspective view of a continous motion article packer of the type having a controller embodying the present invention.

Referring now to FIG. 1, a drop packer of the continuous motion type using a controller embodying the present invention is shown generally by the numeral 10. Briefly, articles such as bottles are continously fed in the direction of arrow 12 from an upstream product supply location generally designated 13 downstream on bottle conveyor means 11 toward an infeed station located generally at 14 where slugs of bottles are loaded into grid structures 18, 18. The grid structures 18, 18 move from the infeed station 14 along a circular path in the direction of arrow 16 to a discharge station shown generally at 20. The discharge station 20 is located below and in substantially vertical alignment with the infeed station 14. Upwardly open packing cases 17, 17 are fed in the direction of arrow 22 from an upstream case supply location generally designated 15 downstream toward the discharge station 20 along a case conveyor means indicated generally by the numeral 24. The grids 18, 18 holding the bottles to be transferred and the packing cases 17, 17 move in a timed relationship such that a grid 18 and a packing case 17 pass through the discharge station 20 at substantially the same instant in time allowing the slug of bottles to be dropped from a grid 18 into a packing case 17 as the grid and case are in substantial alignment. The discharge of bottles takes place without cessation of movement of the grids 18, 18 along their circular path so that continuous motion of both the packing cases 17, 17 and the grids 18, 18 is maintained during the grid loading and emptying operations. The packing cases 17, 17 continue to move downstream in the direction of arrow 22 to be unloaded at a downstream location generally designated 19.

A packer of the continous motion type, as briefly described above, is manufactured by the Standard Knapp Company, Portland, Connect., and may be used to practice the present invention. Such a packer is illustrated and described in U.S. patent application Ser. No. 425,104, filed Sept. 27, 1982, now U.S. Pat. No. 4,457,121 and assigned to the assignee of the present invention. The above-mentioned U.S. patent application is hereby adopted by reference into the present disclosure.

Still referring to FIG. 1, a controller embodying the present invention, is shown generally at 26 and is connected to a number and variety of packer operating controls and detectors, which control and detector functions are explained in further detail below, via cable 28. The controller 26 is also connected to a visual display means or a CRT display means shown generally at 30 via cable 32. The function of the CRT means 30 will become apparent during the disclosure of the invention.

In general, real time processing means or industrial programmable logic control systems such as those manufactured by Modicon, Allen-Bradley and others, are used to interface with and connect to a number and variety of detectors in the packer which monitor various functions and operations associated with the packing process. A logic control system memory also stores a set of controller instructions which are accessed and processed by the logic control system in a predetermined sequence and combination to direct and control the packer operation in response to signals generated by the various detectors.

Figure 2A:
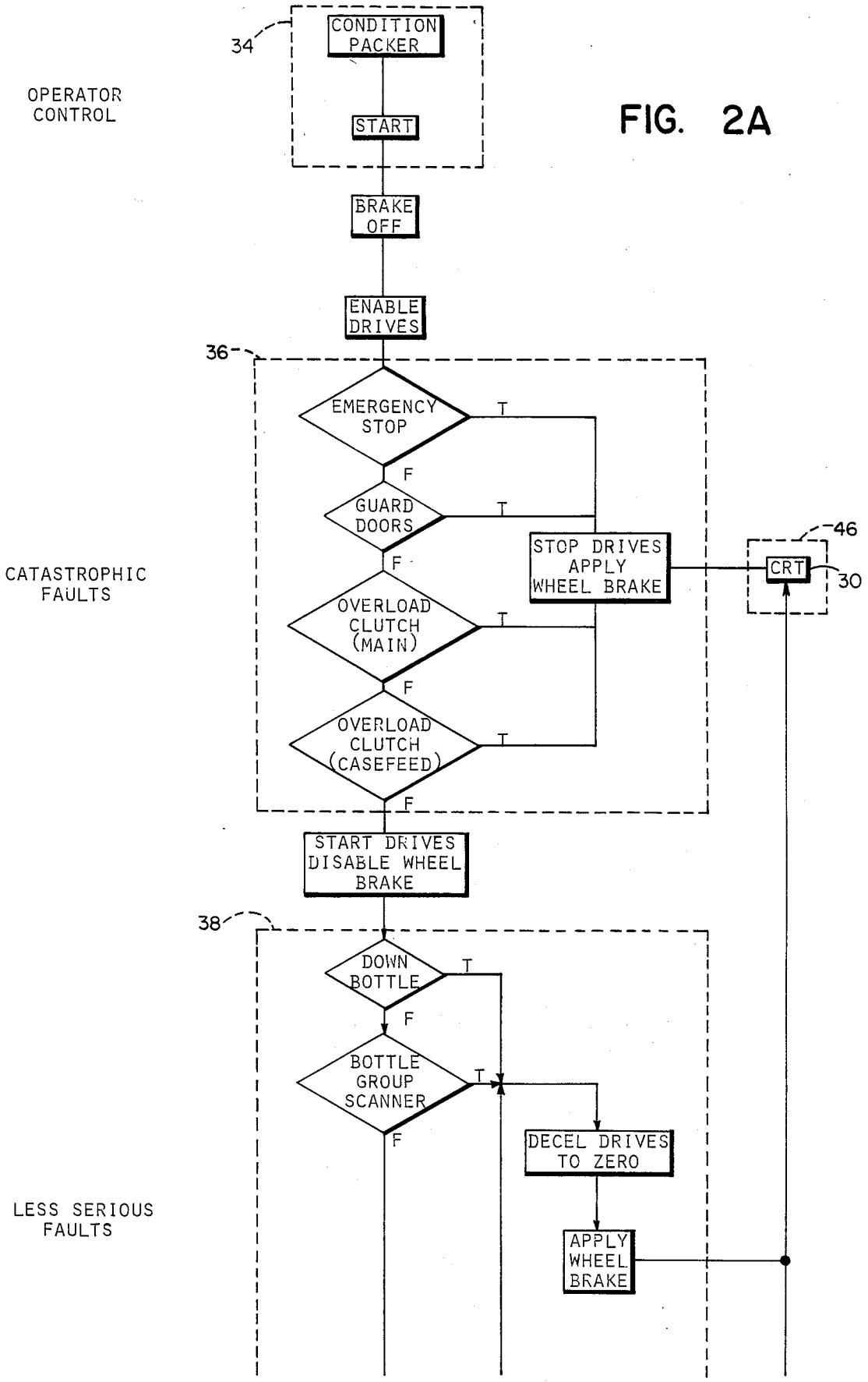
FIGS. 2A, 2B and 2C are respectively the upper, middle and lower portion of a schematic flow chart depicting the overall control signal processing methodology and structure in accordance with the principles of the present invention for a drop type packer controller.
Figure 2B:
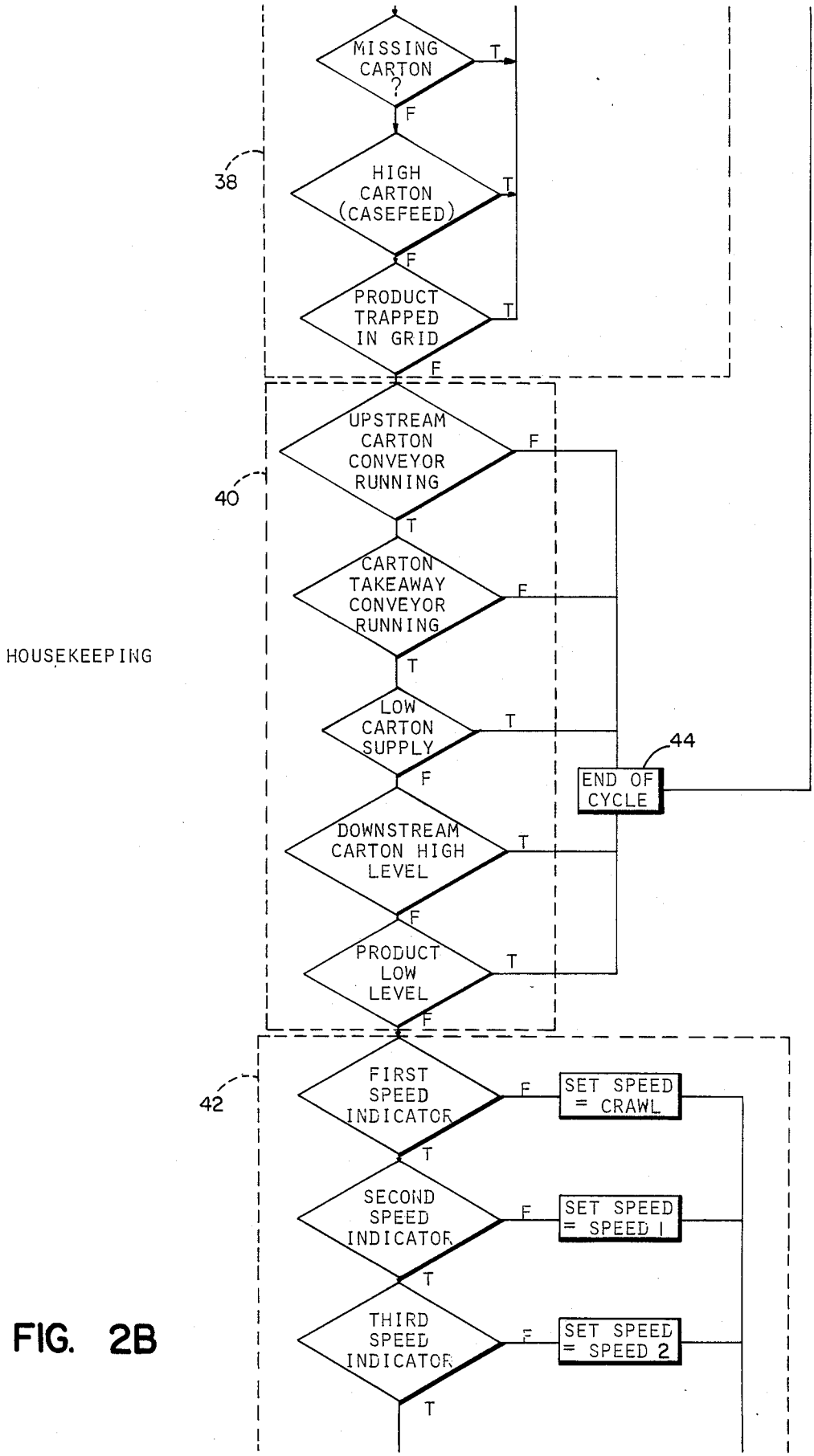
Figure 2C:
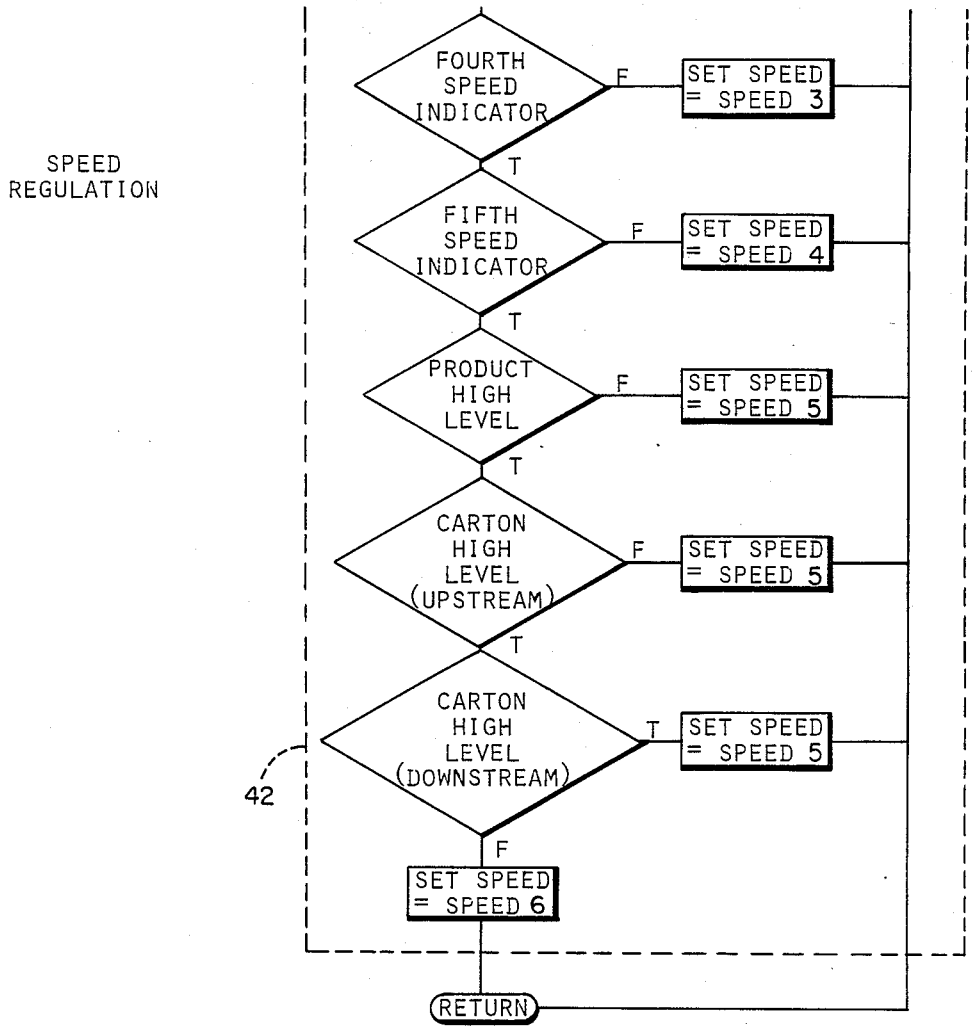

Turning now to the present invention, FIGS. 2A, 2B and 2C herein, referred to as composite FIG. 2, show a schematic flow chart depicting the overall control signal processing methodology and structure. The controller instructions stored in the logic control system memory are broadly represented by the control function blocks shown in dotted lines in the schematic flow chart of FIG. 2. A brief explanation of the control function blocks and their relationship to the packing process will be presented first to give the reader an overview of the controller operation. The operator control function block 34 includes means for selecting one of a number of operating modes, e.g. manual, automatic, start, stop and end of cycle. Prior to beginning the bottle packing operation, the operator control 34 conditions the packer by releasing the wheel brakes and enabling the packer drive mechanisms. After the packer is conditioned, the controller instructions contained in the catastrophic fault control function block 36 determine if a condition associated with the packer operation exists that requires an immediate stop to prevent damage to the packer, bottles, cases and operating personnel. Next, controller instructions contained in the less serious fault control function block 38 determine if a condition associated with the packer operation exists that potentially can cause difficulties in the packing process and when such a condition is present cause the packer to be brought a smooth and controlled stop within a predetermined time. After it has been determined that no faults are present, controller instructions contained in the housekeeping control function block 40 determine if a sufficient supply of bottles and packing cases are available to insure uninterrupted bottle transfer. Once it has been determined that a sufficient supply of bottles and packing cases are available, the controller instructions contained in the speed regulation control function block 42 cause the bottle transfer rate to increase, decrease or remain constant at one of a number of one or more predetermined bottle transfer rates. The predetermined rates are calculated to insure that sufficient numbers of bottles can be queued at the infeed station 14 to provide complete slugs of bottles to the grids 18, 18. If it is determined that a limited supply of bottles and packing cases are available or that some other condition exists that could impede bottle transfer, the controller instructions in the end of cycle control function block 44 cause the packing process to come to a halt in a orderly and controlled manner so that bottles remaining on the conveyor means 11 are advanced to the infeed station 14 for grouping and readiness for a restart. The end of the cycle controller instructions are described in the discussion of FIG. 3 below.

The control function block controller instructions are accessed once during each logic control system execution cycle which in the illustrated case is approximately 15 milliseconds; that is, input controller instructions and updated operating parameters are fed to the logic control system at least once every 15 milliseconds for real time processing to provide substantially instantaneous feedback information relative to the packer status and operation to provide a continuous transfer of bottles without the abrupt start-stop operation encountered with prior packers.

As is illustrated in FIG. 2, the major control function blocks 36, 38, 40, and 44 provide outputs to a CRT control function block 46. The outputs from the control blocks are in the form of encoded messages and represent the packer status and operation. The messages are displayed on the CRT display means 30 and may provide instructions to a machine operator to attend to a detected fault or warn of low bottle supply or other such items associated with the packer operation. Also, some of the encoded messages may be generated and displayed for diagnostic purposes to aid in clearing troubles or as an analytical tool for use in evaluating the packing process.

Now having described the general control signal processing methodology, a more detailed description may be had from the following discussion of the controller instructions contained within the dotted line control function blocks of FIG. 2 and the packer shown in FIG. 1. Starting with the operator control function block 34, the packer is conditioned to transfer bottles from the infeed station 14 to the discharge station 20 via a manual load and empty control cycle as explained below in conjunction with FIG. 4. Once conditioned, the packing process is started by a Start Command Signal initiated by either an operator via a control panel at the controller 26 or by an electronic command signal from a location remote to the operator panel. Once started, wheel brakes which prevent the various packer drive mechanisms from operating are enabled for release and the drive mechanisms are conditioned to a ready status. Prior to engaging the drive mechanisms and disabling the wheel brakes, the controller instructions in the catastrophic fault function block 36 scan the appropriate control signals to determine whether an emergency stop has been initiated via the control panel and if any guard doors providing access to the packer have been left ajar. In addition, the various clutches which couple the drive mechanisms to the packer are checked for overload conditions. When any of the catastrophic fault conditions are determined by the control logic system to be in a true state, the controller program instructions exit to an automatic emergency stop procedure which brings all drive mechanisms to a stop status and causes the wheel brakes to be applied. In addition, an encoded message is inputted to the CRT function block 46 which in turn causes the CRT display means 30 to display an appropriate message to provide information to an operator or trouble shooter. If all the examined conditions are false, that is, if the controller instructions have not detected the level of fault which can be classified as a catastrophic fault, the drives are started and the wheel brakes are disabled allowing the packer to commence operation.

Next the less serious fault controller instructions contained within the function block 38 scan various detectors located within the packer for input to the logic control system processing means which in turn utilizes these control signals to determine an appropriate course of action. A bottle down scanner detector 48 and a bottle group scanner detector 50 are located along the conveyor means 11 immediately preceding the infeed station 14 and function to monitor the bottle feeding operation. The detectors 48,50 are polled by the logic control system to determine if bottles are upright in the input feed lanes, the lanes being shown generally by the numeral 21 and if a sufficient number of bottles are present in the grouper 52 to form a slug which will completely fill a grid 18 present at the infeed station 14. A missing case scanner detector 56 located at a predetermined position along the case feed conveyor means 24 senses the presence or absence of a case. The case missing detector 56 is polled by the logic control system to determine whether a packing case 17 will be present at the discharge station 20 at the time a grid 18 is ready to discharge its bottles into the case. The controller instructions also cause the logic control system to poll a discharge station case detector 54 to determine whether the packing case present has lifted from the conveyor means 24 to a height which could cause a jam between a grid 18 and the high case.

The grids 18, 18 are also inspected by grid blocking detectors 68, 68 as the grid leaves the discharge station 20 to insure that bottles have not remained in the grid structure which would cause jamming or other damage to the next slug loaded into the blocked grid. The grid blocking detectors 68, 68 also provide means to determine whether or not any of the bottles may have broken during the transfer process. The presence of a grid blocked signal also causes the logic control system to provide a message via the CRT means 30 to an operator that one of the packing cases 17, 17 is probably missing one or more bottles.

When any of the less serious fault control signals are in a true state, the controller 26 immediately directs the packer to a course of action which causes the drive mechanisms to decelerate to zero and provides an automatic application of the wheel brake to bring the packing operation to a smooth but immediate halt. An output signal is also provided to the CRT function block 46 in a manner similar to that described above to display on the CRT means 30 a message related to the fault detected.

If no faults are detected during the less serious fault controller instruction cycle, the controller instructions in the housekeeping function block 40 scan the appropriate housekeeping detectors to insure that as the bottle transfer rate is increased by the logic control system there will be no impediments to the transfer packing process. A case supply conveyor detector 58 is scanned for a signal indicating that the case conveyor means 24 is running and likewise the case take-away conveyor detector 60 is scanned for a signal to insure that the take-away conveyor means 61 is operative so that cases are not left at the discharge station 20. Also an upstream case supply detector 62 located at the upstream case supply location 15 is scanned to detect the presence of packing cases. A case present signal generated by detector 62 is interpreted by the logic control system processing means that a sufficient quantity of cases is available to accommodate bottle transfer for a predetermined period of time. Downstream case detectors 64, 64 located at predetermined intervals along the case take-away conveyor means 61 are scanned to determine if cases have backed up along the carton take-away conveyor 61 toward the discharge station 20. When cases are detected at the downstream case sensor 64 closest to the discharge station 20, the logic control system processing means determines that cases are being filled faster than they are being removed from the downstream unload location 19.

Upstream bottle supply detectors 66, 66 are polled by the logic control system to determine if bottles are present at the corresponding supply detector 66 along the bottle conveyor means 11. When the supply detector 66 located at the upstream bottle supply location 13 senses bottles present, a high product supply signal is sent to the logic control system processing means for use in selecting one of a number of predetermined bottle transfer rates as described below.

Should any of the housekeeping detectors provide a control signal indicative of a potential impediment to bottle transfer, the logic control system accesses the controller instructions contained in the end of cycle function block 44 and causes the drive mechanisms and wheel brakes to bring the packer to a controlled and orderly stop. When the end of cycle controller instructions are activated an appropriate encoded message is sent to the CRT function block 46 for display on the CRT display means 30.

Once the housekeeping controller instruction cycle is completed, the speed regulation controller instructions contained within the function block 42 causes the logic control system to scan one or more bottle present detectors 66, 66 for signals which when processed by the logic control system processing means cause the packer to increase, decrease or maintain a predetermined bottle transfer rate. The detectors 66, 66 are located at predetermined intervals along the bottle supply path and provide signals indicating that bottles are present at that particular sensing location. The detectors are fundamentally mass population detectors and function under the theory that if bottles are present, an accumulation of bottles exists from that location downstream to the infeed station 14. By extending the detectors 66, 66 away from the infeed station 14 toward the upstream bottle supply location 13, the logic control system processing means can determine the number of bottles available for transfer. Also, by polling the detectors 62, 62 along the case supply conveyor 24, the processing means can determine the number of bottles that can be transferred before running out of cases. For example, if sufficient bottles are determined to be present along the bottle conveyor 11 for feeding to the infeed station 14 to permit transfer at a maximum rate, but only a limited number of cases are determined to be available along the case conveyor means 24, then the logic control system processing means will determine a bottle transfer rate slower than the maximum. However, as the controller instructions scan the case supply detectors 62, 62 and signals are present indicating that cases are available along the case conveyor means 24 at distances further away from the discharge station 20 toward the upstream case supply location 15, the logic control system processing means determines that a faster bottle transfer rate can be accommodated and provides the drive mechanisms with the appropriate increase speed commands. By examining each of the various detectors via the controller instructions, the logic control system processing means continuously determines the maximum bottle transfer rate that the packer can accommodate without damage to the bottles or other adverse consequences to the packing process. In the present embodiment, six upstream bottle supply detectors 66, 66, one downstream case detector 64 and one upstream case supply detector 62 are used to provide continuous signals to the logic control system processing means for speed regulation control.

Figure 3:
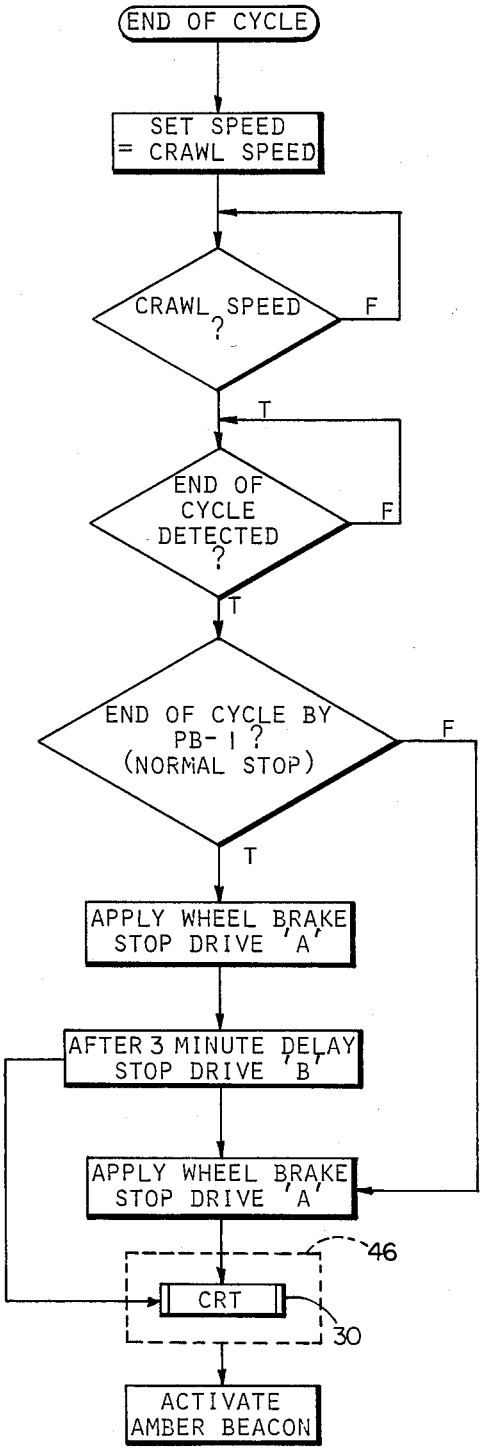
FIG. 3 is a schematic flow chart depicting the end of cycle control signal processing methodology.

Turning now to FIG. 1 and FIG. 3, the end of cycle control function block 44 controller instructions are shown in FIG. 3 in a schematic flow chart. As can be seen from the flow chart, when the end of cycle controller instructions are accessed, the speed regulation controller instructions are pre-empted and the logic control system processing means causes the drive mechanisms to run at a predetermined, much slower rate referred to as the packer crawl speed. Once crawl speed is reached the controller instructions look for an end of cycle command from the logic control system processing means indicating that the grids 18, 18 have moved from the infeed station 14 to the discharge station 20 for a predetermined number of cycles. As can be seen from the flow chart, the end of cycle command can be initiated via the control panel to cause the packer to come to a delayed stop or via a controller instruction as described above. When the end of cycle is initiated from the control panel, the controller stops the packer and case feed by sending an appropriate control signal to the wheel brake and main drive to stop the case conveyor 24 and grouper 52. The controller also shuts off the bottle supply after a predetermined interval by sending an appropriate control signal to stop the bottle conveyor 11. The purpose of delaying the stopping of the bottle conveyor is to allow the bottles that are present along the bottle supply route to be accumulated at the bottle grouper and indexing section 52 so that bottles are not left dispersed along the feed path. If the end of cycle controller instructions are accessed in response to a logic control command, the case supply conveyor 24 is stopped immediately through application of the wheel brake and stopping the associated drive mechanism. In either case an appropriate message signal is sent to the CRT function block 46 which in turn generates the associated display information on the CRT means 30 along with an alarm signal to drive a visual indicator to draw the attention of operating personnel that an end of cycle sequence has occurred.

Figure 4:
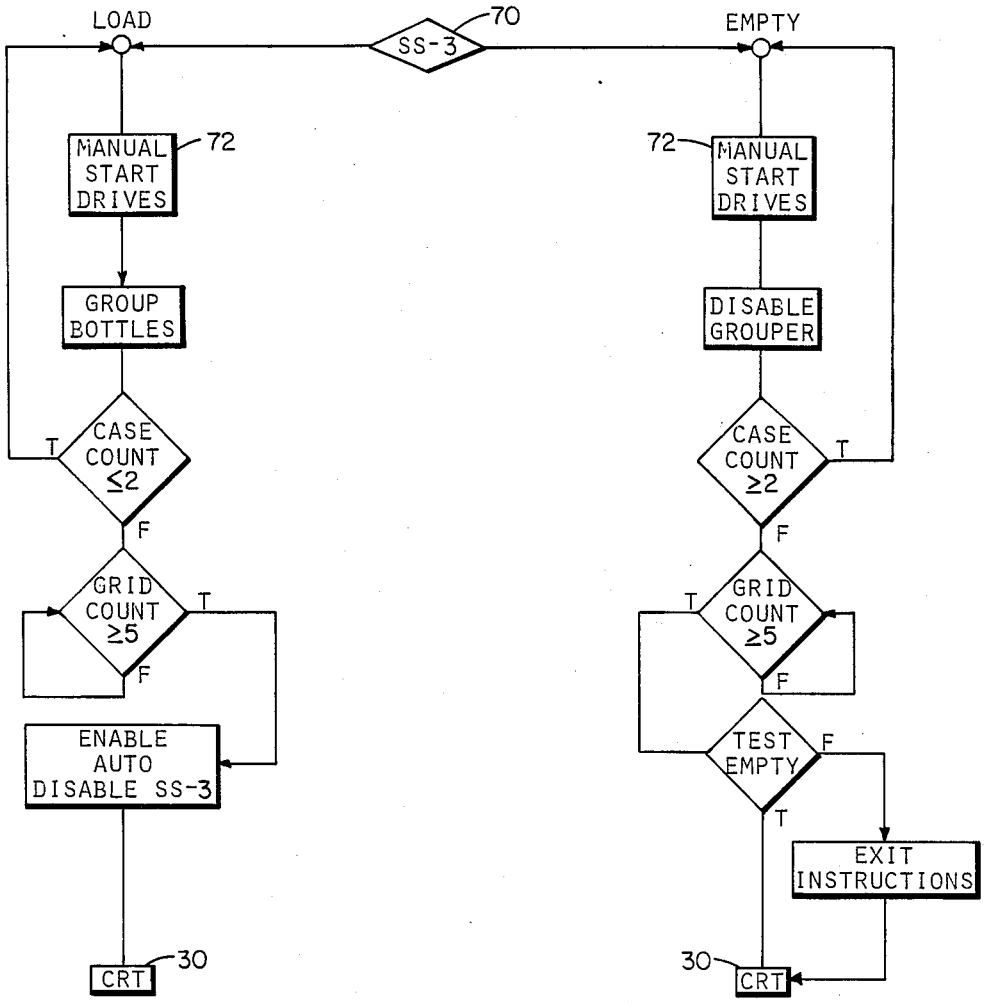
FIG. 4 is a schematic flow chart depicting the article and packing case load and empty control signal processing methodology.

Referring now to FIG. 1 and FIG. 4, the controller instructions stored in the controller instruction memory also contain a sequence of instructions which allow the loading and emptying of the case conveyor 24, the bottle conveyor 11 and the grids 18, 18. The load and empty controller instructions are depicted by the flow chart of FIG. 4. The load sequence conditions the packer at the beginning of the bottle transfer cycle to insure the operational integrity of the packing process and to prime the packer with bottles and cases. The empty sequence is used at the completion of a given packing run to empty the grids 18, 18 and cases from the case conveyor 24. The load and empty sequence enables the packer to advance through the packing cycle step by step and therefore can also be used as a diagnostic aid to a troubleshooter during trouble clearing procedures. The sequence utilizes a combination of the various controller instructions and indicating signals as provided by the various detectors described above.

Selection of either the load or empty mode of operation is selectable from the control panel at the controller 26 via a selector switch 70. Beginning first with the load sequence, the controller instructions prevent the transfer of cases 17, 17 from the case conveyor 24 to the discharge station 20 until a predetermined number of slugs of bottles has been released from the grouper 52. As can be seen from the flow chart, the manual input function block 72 provides a signal to engage the packer drive mechanisms. The drives are engaged during single cycle operation only for the time necessary to cause the normal advancement of cases 17, 17 along the case conveyor 24 which correlates to the time required for a grid 18 to leave the discharge station 20 and a subsequent grid 18 to arrive at the discharge station 20. In addition to advancing packing cases 17, 17 along the case conveyor 24, bottles are advanced along the bottle feed path and are grouped by the grouper 52 to form a complete slug. In one preferred embodiment of the controller, grids 18, 18 appearing at the infeed station 14 will receive a slug of bottles only after the logic control system determines that at least two load single cycle operations have been completed releasing two cases. The grids are advanced along the circular path 16 and now filled until the first grid that was filled during the load single cycle arrives back at the infeed station 14. Thus, seven load single cycle operations are required to enable automatic operation. In the present invention, a five step increment is required to complete a grid cycle since there are five grids 18, 18 in the illustrated packer. The controller may be used with a packer having a different number of grids provided the proper timed relationships are maintained by the bottle infeed, grid movement and packing case advancement. Once the logic control system has determined that the first grid filled has returned to the infeed station 14, the packer is returned to an automatic mode of operation and the load sequence is disabled. An appropriate message is displayed on the CRT display means 30 to indicate the current packer status.

The empty cycle shown in the flow chart of FIG. 4 is also selectable by switch 70. The cycle begins again with the manual input function block 72 which starts the drives for the time necessary to advance the grids 18,18 and packing cases 17,17 in the proper timed relationships. However, during the empty cycle the bottles are no longer grouped into slugs for filling of the grids 18, 18. Slugs remaining in the grids 18,18 continue to be deposited into the cases 17,17 until the logic control system determines that less than two packing cases 17,17 are available for loading or that the grid 18 present at the infeed station 14 at the beginning of the empty cycle has completed one revolution. A grid empty test is carried out by scanning the grid blocking detectors 68,68 to ensure that all bottles have been removed from the grids. If all bottles have been removed an appropriate message is displayed on the CRT display means 30 indicating that the packer has been emptied and is in a ready status to begin a new packing run. If the test for empty grids is false, the empty controller instruction cycle is exited and an appropriate encoded message is provided to the CRT display means 30.

A controller for a drop bottle type case packer and the control signal processing methodology for the operation of such a controller has been described in one preferred embodiment and numerous substitutions and modifications can be had without departing from the spirit of the invention. Accordingly, the present invention has been described merely by way of illustration rather than limitation.

We claim:

1. In a packer of the type having conveyor means for advancing a plurality of articles along a first horizontal path, an infeed station, a grid structure for receiving said articles at said infeed station, a discharge station, case conveyor means for delivering upwardly open packing cases to said discharge station along a second horizontal path, means for moving said grid structure from said infeed station to said discharge station, means for releasing said articles from said grid structure at said discharge station causing said articles to drop into said packing cases and a controller for operating said packer, said controller comprising:

controller instruction storage means for storing a plurality of controller instructions capable of directing packer operation;

a plurality of article position detectors associated with said article conveyor means and providing article present control signals to indicate the presence of an article at each corresponding detector location, said detectors being spaced from one another at predetermined intervals along the article conveyor means;

means for sensing the presence or absence of said article present control signals addressed as to their locations;

at least one packing case position detector associated with said case conveyor means, said case detector providing a case present control signal indicating the presence of at least one case at said corresponding detector;

means for sensing the presence or absence of said case present control signal;

at least one article blocking detector associated with said grid structure, said blocking detector providing a control signal to indicate whether one or more articles has failed to drop from its position in the grid;

means for sensing the presence or absence of said grid blocking control signal;

real time processing means for accessing said controller instructions in said controller instruction storage means and for executing certain of said instructions in response to said article and case detector control signals to effect one of a number of predetermined courses of action, and means responsive to said real time processing means for causing said packer to operate in accordance with said predetermined course of action.

2. In a packer having a controller as defined in claim 1 wherein said controller includes commmunicating means for providing a plurality of messages to the machine operator, said messages containing information associated with the operational status of said packer.

3. In a packer having a controller as defined in claim 1 wherein certain of said predetermined courses of action include preselected article transfer rates and regulating the preselected article transfer rate associated with said predetermined course of action.

4. In a packer having a controller as defined in claim 3 wherein other of said predetermined courses of action include stopping said article conveyor means and stopping said packing case conveyor means in a predetermined sequence of timed actions.

5. In a packer having a controller as defined in claim 1 wherein a plurality of said case position detectors are provided in spaced relationship and at predetermined intervals along said case conveyor means, and said at least one case detector being located at said discharge station, and said means for sensing said corresponding control signals including the capability for addressing such case present control signals.

* * * * *